US005188044A

United States Patent [19]

Brockmann

[11] Patent Number: 5,188,044

[45] Date of Patent: Feb. 23, 1993

[54] FOLDING DEVICE FOR SEWING A SECOND WORKPIECE ONTO A FIRST WORKPIECE IN AN AUTOMATIC SEWING MACHINE

[75] Inventor: Joachim Brockmann, Enger, Fed. Rep. of Germany

[73] Assignee: Dürkopp Adler Aktiengesellschaft, Fed. Rep. of Germany

[21] Appl. No.: 839,092

[22] Filed: Feb. 20, 1992

[30] Foreign Application Priority Data

Feb. 25, 1991 [DE] Fed. Rep. of Germany ..... 4105859

[51] Int. Cl.[5] ..... D05B 21/00

[52] U.S. Cl. ..... 112/121.15; 112/104; 112/147

[58] Field of Search ..... 112/121.15, 104, 147, 112/306, 113, 121.11, 121.12

[56] References Cited

U.S. PATENT DOCUMENTS

| | | | |
|---|---|---|---|
| 4,793,272 | 12/1988 | Scholl et al. | 112/121.15 |
| 4,967,675 | 11/1990 | Goldbeck et al. | 112/104 X |
| 5,016,549 | 5/1991 | Sadlack et al. | 112/121.15 X |
| 5,029,542 | 7/1991 | Ferguson | 112/121.15 X |

FOREIGN PATENT DOCUMENTS

| | | |
|---|---|---|
| 3843000 | 11/1989 | Fed. Rep. of Germany . |
| 8909299 | 10/1989 | PCT Int'l Appl. . |

*Primary Examiner*—Peter Nerbun

*Attorney, Agent, or Firm*—Ostrolenk, Faber, Gerb & Soffen

[57] ABSTRACT

A second workpiece, for instance a pocket blank, is placed with its edge regions protruding on at least three sides, on a folding device which forms part of the automatic sewing machine. The folding device has a swingable outer frame which has a plurality of inwardly and outwardly moveable bend-over devices with Z-shaped angles which fold the protruding edge regions around a so-called "sword". Thereupon, the folded second material is placed on a first workpiece which is present in a receiving station. Then the folded edge regions are continuously fixed over their entire length by a holding element which is embedded in an insert plate provided within the receiving station. The holding element permits the bend-over devices to move back away from the workpieces into their starting position, without carrying the folded edge regions along with them and thereby unfolding the folded edge regions.

17 Claims, 9 Drawing Sheets

FOLDING DEVICE FOR SEWING A SECOND WORKPIECE ONTO A FIRST WORKPIECE IN AN AUTOMATIC SEWING MACHINE

BACKGROUND OF THE INVENTION

The present invention relates to a folding device for sewing a second workpiece onto a first workpiece in an automatic sewing machine.

A folding device for an automatic sewing machine for sewing a second sewing material workpiece onto a first sewing material workpiece is known from German Patent DE 37 09 210 C2 (corresponding to U.S. Pat. No. 4,793,272). The folding device has a support plate for receiving the first workpiece, a sword arranged on a sword carrier to receive the second workpiece, and an outer frame arranged on an outer-frame carrier, the outer frame having bend-over means for folding edge portions of the second workpiece around the sword, the sword being moveable by its sword-carrier between a lower working position on the support plate, and an upper working position above the support plate, and the outer frame being moveable by the outer-frame carrier into a lower working position on the support plate and a position near the upper working position of the sword.

The first sewing material is placed on the support plate, properly marked, before the start of the sewing process, and the second sewing material—for instance a pocket blank—is placed on a so-called "sword". The sword is arranged on a sword support so that, on the one hand, it is swingably moveable in the direction toward or away from the support plate; and, on the other hand, is movable into a retracted position in the horizontal plane starting from a lower working position on the support plate. Furthermore, the folding device also includes an outer frame having bend-over means which are arranged thereon and can be positioned in three different positions of swing. The bend-over means fold the second sewing material around the aforementioned sword in such a manner that at least three edge regions, extending beyond the sword, of the second sewing material which is placed on the sword, are folded downward, i.e. bent over. Thereupon the second sewing material which has been folded around the sword is lowered, together with the sword and the outer frame, onto the first sewing material, the second and first parts being held clamped between the support plate, the outer frame, and the sword.

As a result of this folding process, there is an accumulation of at least four layers of material in the upper region of the second sewing material—for example, in the region of engagement of the pocket which is to be sewn on—and a further accumulation of four layers of material in the lower region. When pockets with rounded edges are sewn on, folds occur in the inner regions (the regions of minimal radius) of the rounded corners, due to the pushing together of the folded edge regions, causing an uncontrollable thickening of the second material at the place in question. Between the upper and lower regions of the folded second material, on the other hand, there are only two layers of material, namely one layer of the first material and another layer of the second material.

The main disadvantage of the known folding device is that the folded second material is dependably clamped only in the region of the maximum accumulation of layers of material—for instance in the region of engagement of the pocket to be sewn on—after the folding process has been carried out, while at all other places within the folded edge regions, the folded edge in question is not fixed by sufficient clamping pressure. After the second material which has been folded around the sword is placed on the first material, the bend-over means is withdrawn back into its inactive starting position. When this occurs, it is unavoidable that at the insufficiently fixed places, the folded edges of the second material—particularly when it is very thin material, for instance formed of microfibers—are carried along (for example being rolled out). As a result, the properly folded second material workpiece is partially unfolded. In this way, an accurate seating of the second material on the first material cannot be obtained. This disadvantageous effect is further increased by possible wrinkling in the region of the insufficiently fixed folded edges of the folded second material.

German Utility Model No. 19 64 067 (corresponding to U.S. Pat. No. 3,528,378) discloses a machine for sewing pockets onto articles of clothing in which, on the lower side of a table part which is recessed in a table plate and can be raised and lowered, there are provided a plurality of fixing rams which are arranged spaced from each other. These rams can be extended in the vertical direction under the influence of pressure means and, in this connection, press upward from below, against the article of clothing, thereby fixing the previously folded, i.e., bent-over, edge regions of the pocket part between the article of clothing and the support plate, which acts as a "sword." Because of their spaced arrangement, it is not possible with these fixing rams to obtain a continuous, uninterrupted fixing of the folded edge regions over their entire length. In the case of the above-mentioned pockets with rounded edges, the folds that are always present in the corner regions prevent the previously folded edge regions of the bent-over pocket blank from being effectively fixed.

The prior art (DE 38 43 000 A1) also discloses a pressure hose which is relevant to the background of the invention. This publication discloses an annular clamping device, which is developed as a fold-free hose which can be acted on by pressure means, clamping a flat material in an embroidery frame.

The disclosures of all prior art materials mentioned herein are expressly incorporated by reference.

SUMMARY OF THE INVENTION

It is therefore an object of the present invention to develop a folding device which can provide continuous fixing of the folded edge regions of sewing material workpieces to be sewn together, over the entire length of the edges, regardless of the number of layers of material present at the time.

This object is achieved by a folding device having the features disclosed herein.

With the folding device of the invention, the result is advantageously obtained that the folded end regions of the second material are fixed non-displaceably so that when the bend-over means withdraws into its inactive starting position, the folded edge regions are not carried along, i.e., not distorted. In this way, the invention satisfies an essential requirement, namely accurately seating the folded second material on the first material, the so-called main material.

Other features and advantages of the present invention will become apparent from the following description of the invention which refers to the accompanying drawings.

DETAILED DESCRIPTION OF THE INVENTION

Figure 1:
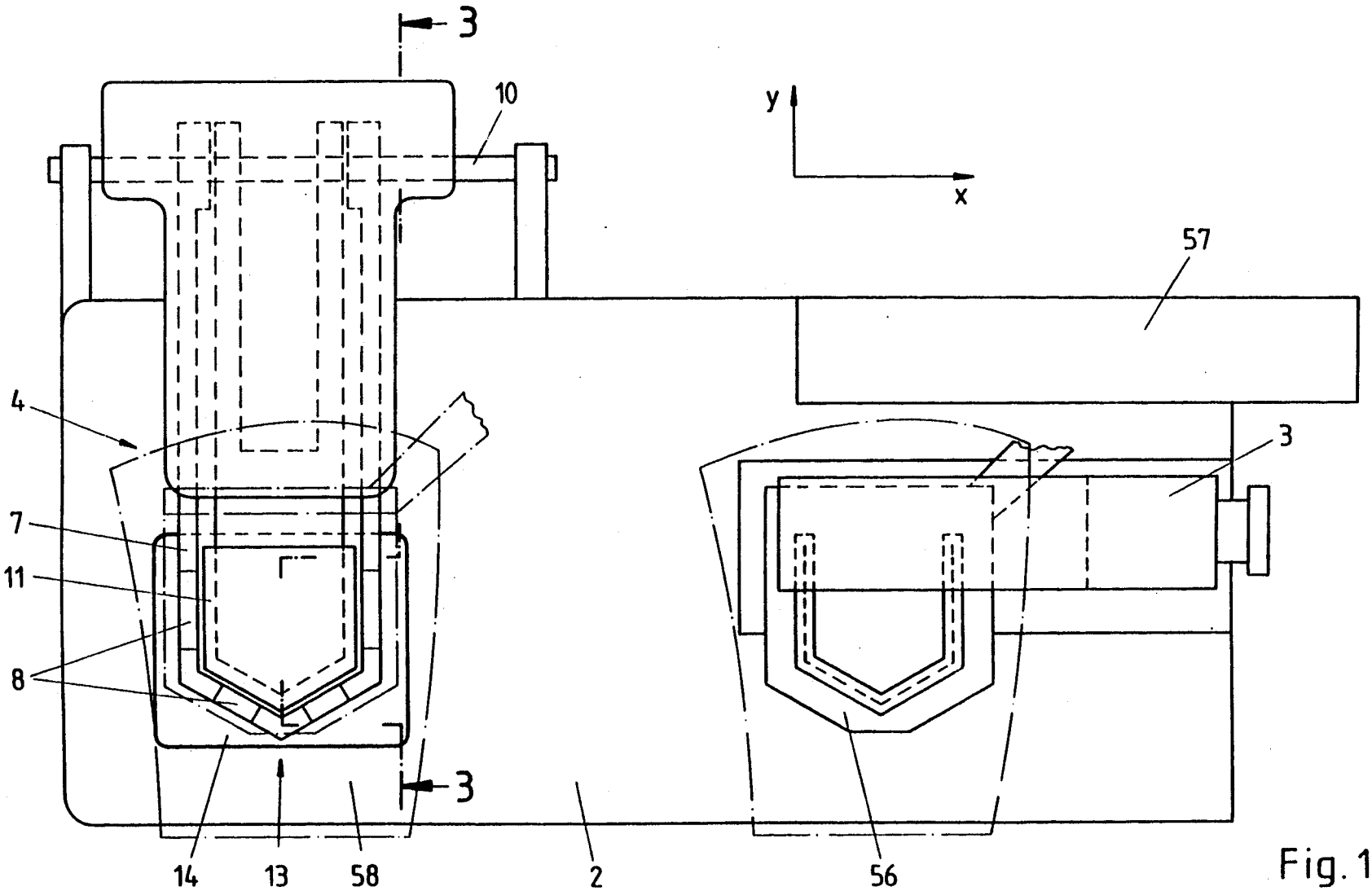
FIG. 1 is a top view of the automatic sewing machine equipped with the folding device.
Figure 2:
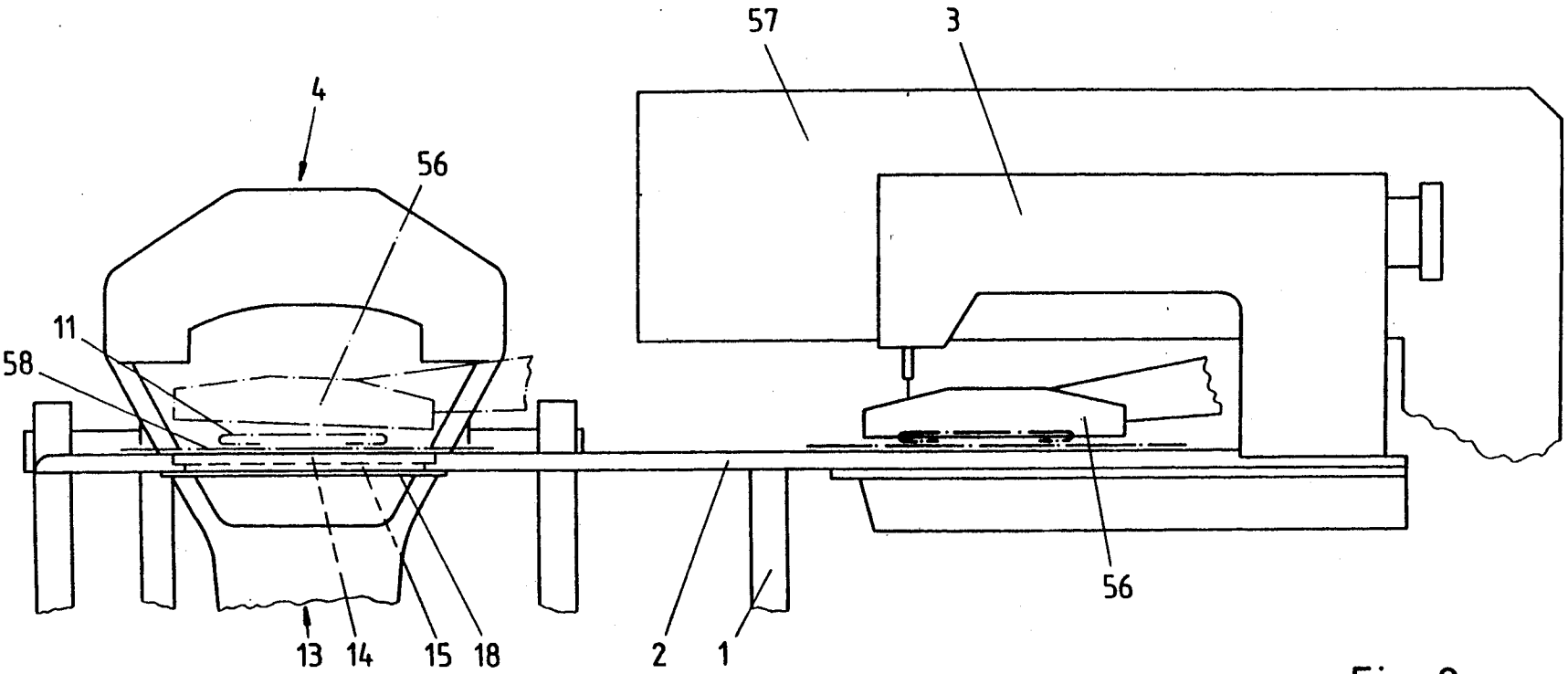
FIG. 2 is a front view of the automatic sewing machine equipped with the folding device.

The automatic sewing machine shown in FIGS. 1 and 2 has a frame 1 on which there is fastened a support plate 2, and on the latter a sewing head 3. To the left of the sewing head 3 is a folding device 4, shown in greatly simplified form. As can be noted from FIGS. 3 to 5, the folding device 4 comprises a sword-carrier 5, a sword 6 fastened to it, and an outer frame 7 with several bend-over devices 8 supported displaceably on the latter. The outer frame 7 is fastened on an outer-frame carrier 9. The sword-carrier 5 and the outer frame 7 are swingably mounted independently of each other on a shaft 10.

Figure 3:
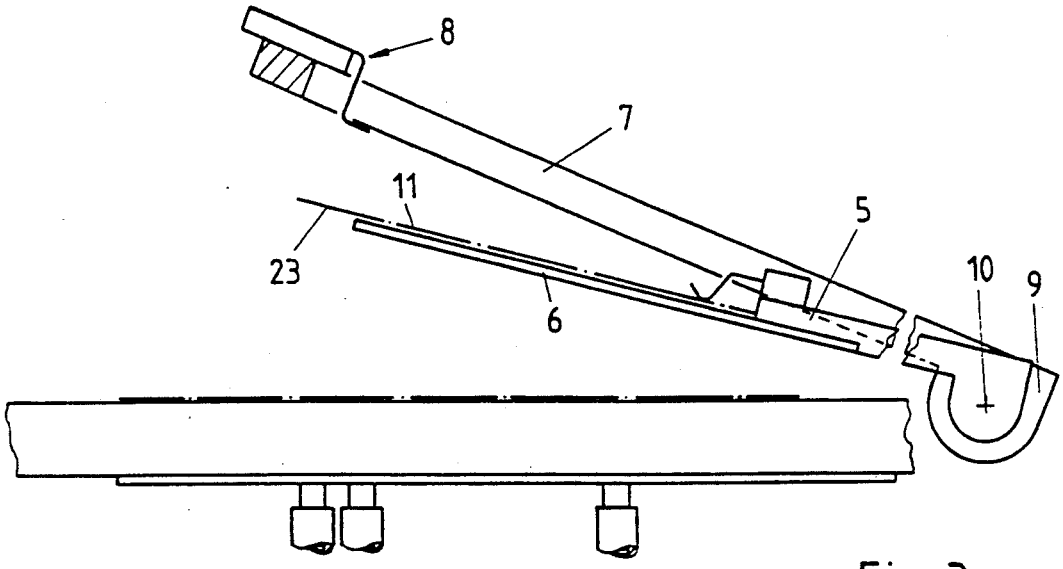
FIG. 3 is a simplified side view of the folding device taken along section line 3—3 in FIG. 1, the sword and the outer frame being in their upper position.
Figure 4:
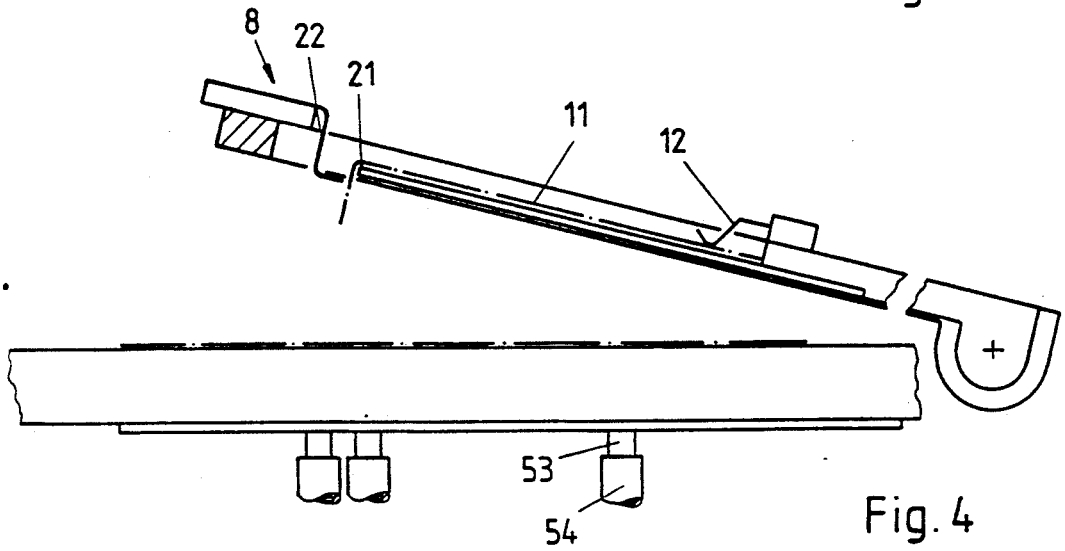
FIG. 4 is a simplified side view of the folding device taken along section line 3—3 in FIG. 1, the outer frame being in a lowered intermediate position.
Figure 5:
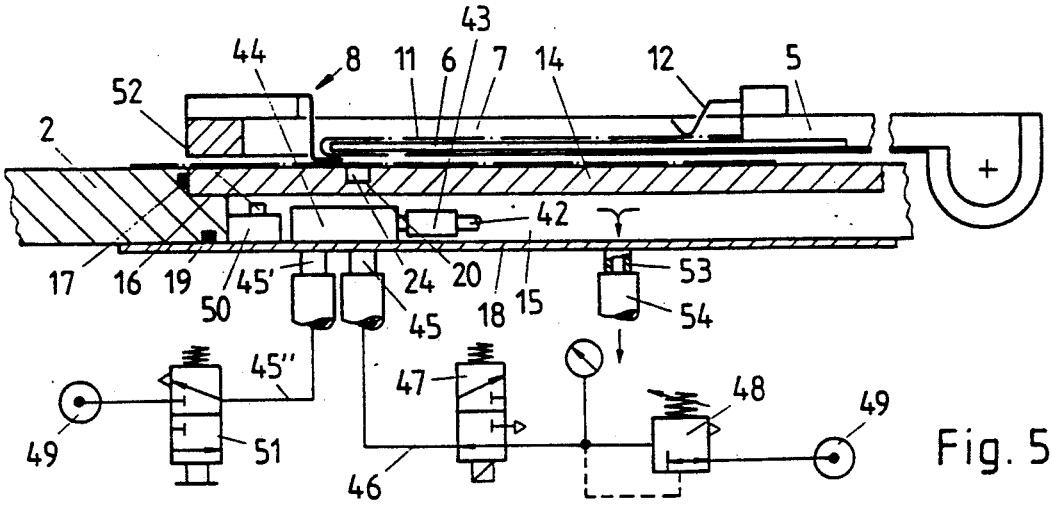
FIG. 5 is a simplified side view of the folding device taken along section line 3—3 in FIG. 1, the sword and the outer frame being in the lower operating position on the support plate.

A second piece of material 11 is placed on the sword 6 and held, as shown in FIGS. 3 to 5, by two material clamps 12. Also as shown, a first piece of material 58 is placed on the support plate 2.

The region of the support plate 2 which is located below the folding device 4 is referred to as a receiving station 13 (FIGS. 1-2). On the latter there is provided an insert plate 14 which covers the top of a suction chamber 15, arranged in the support plate 2. The insert plate 14 is received by a recess 16 arranged in the support plate 2 so that the topside of the insert plate 14 is flush with the top of the support plate 2. As shown in FIG. 5, in the vertical edge of the recess 16 there is arranged a plastic hose 17 serving as packing. The plastic hose 17 is arranged on all sides of the insert plate 14 at the vertical edge of the recess 16 and seals the top side of the suction chamber 15 when the insert plate 14 is inserted, since the insert plate 14 slightly compresses the plastic hose 17. The recess 16 also provides a stop for the insert plate 14 in the support plate 2. The suction chamber 15 is closed at the bottom by a cover plate 18, and there is a further packing 19 between the cover plate 18 and the support plate 2.

As shown in FIGS. 5 and 10-12, the insert plate 14 has a groove 20 of U-shaped cross-section, which is arranged with an edge parallel to the contour of a folding edge 21 of the sword 6, as shown in FIG. 4.

By means of a Z-shaped angle 22, a protruding edge region 23 of the second material 11 which is placed on the sword 6 is bent downward (see FIG. 4) when the outer frame 7, starting from its upper position (see FIG. 3), is swung in counter-clockwise direction into the position shown in FIG. 4. The angle 22 is part of the bend-over device 8. A bend-over device relevant to the background of the invention is disclosed in U.S. Pat. No. 4,793,272, so it is not necessary to give a further description here of the construction and manner of operation of the bend-over device 8.

Figure 11:
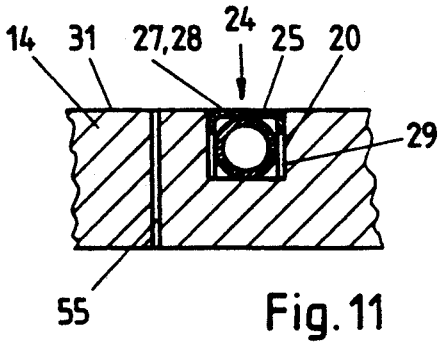
FIG. 11 is an enlarged sectional view, taken along section line 11—11 in FIG. 10, wherein the pressure hose is not acted on by compressed air.
Figure 12:
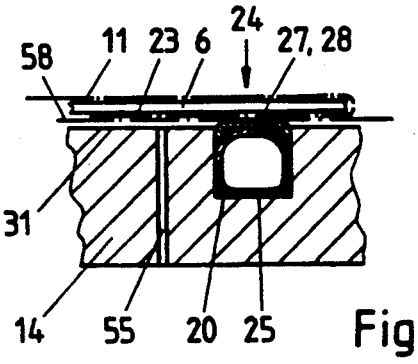
FIG. 12 is an enlarged sectional view taken along section line 11—11 in FIG. 10, wherein the pressure hose is acted on by compressed air.

Within the groove 20 is embedded a holding element 24 which, in the embodiment shown in FIGS. 11 and 12, includes a pressure hose 25. For the latter, a valve rubber hose which is elastic and readily stretchable can suitably be used. The pressure hose 25 must be inflatable within a very short time and should force itself dependably into the corners 26 of the course of the groove 20 and against the corresponding walls of the groove 20.

Figure 14:
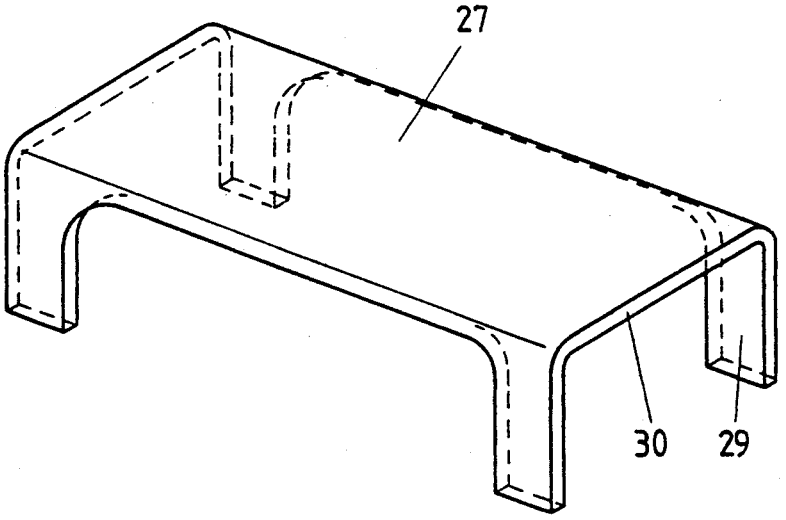
FIG. 14 is a perspective view of a bridge provided with four legs.
Figure 15:
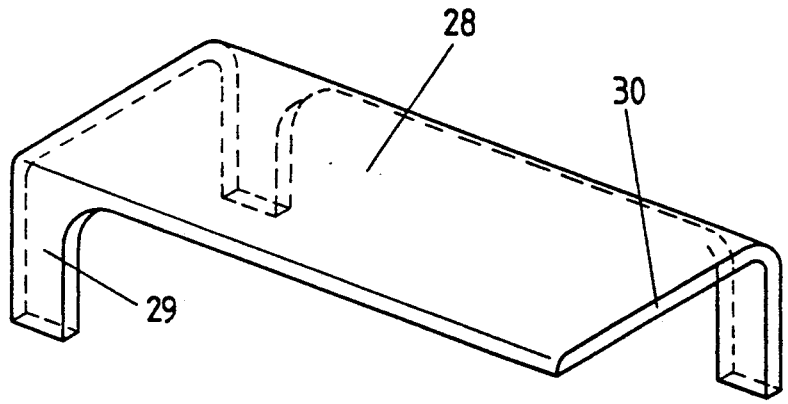
FIG. 15 is a perspective view of a bridge provided with three legs.

The holding element 24 also includes, in addition to the pressure hose 25, several bridges 27, 28, arranged end-to-end (see FIG. 10), which have a U-shaped profile in cross-section. As shown in FIGS. 14 and 15, the bridges 27 have four legs 29 while the bridges 28 have only three legs 29 in order to permit the pressure hose 25 to apply itself properly in the region of the corner 26. The legs 29 grip over the pressure hose 25 (see FIG. 11). There are openings between the legs 29 of each bridge 27 and 28, so that the pressure hose 25, which can be acted on by compressed air of about 3 Bar, applies itself through those openings against the side walls of the groove 20 immediately when the pressure is applied, as shown in FIG. 12. Of course, the pressure hose 25, after it has been pressurized by the compressed air, also rests against the bottom of the groove 20 and against the inside of a web 30 of each bridge 27, 28, whereby each bridge 27, 28 is partially forced out of the groove 20 until striking against a counter-support (see FIG. 12). Furthermore, the length of the legs 29 is such that the top of the web 30 protrudes by about 0.1 mm above a topside 31 of the insert plate 14 when the pressure hose 25 is not acted on by compressed air. The bridges 27, 28 are preferably made from stainless sheet metal 0.3 mm in thickness, for instance chrome-nickel steel.

Figure 10:
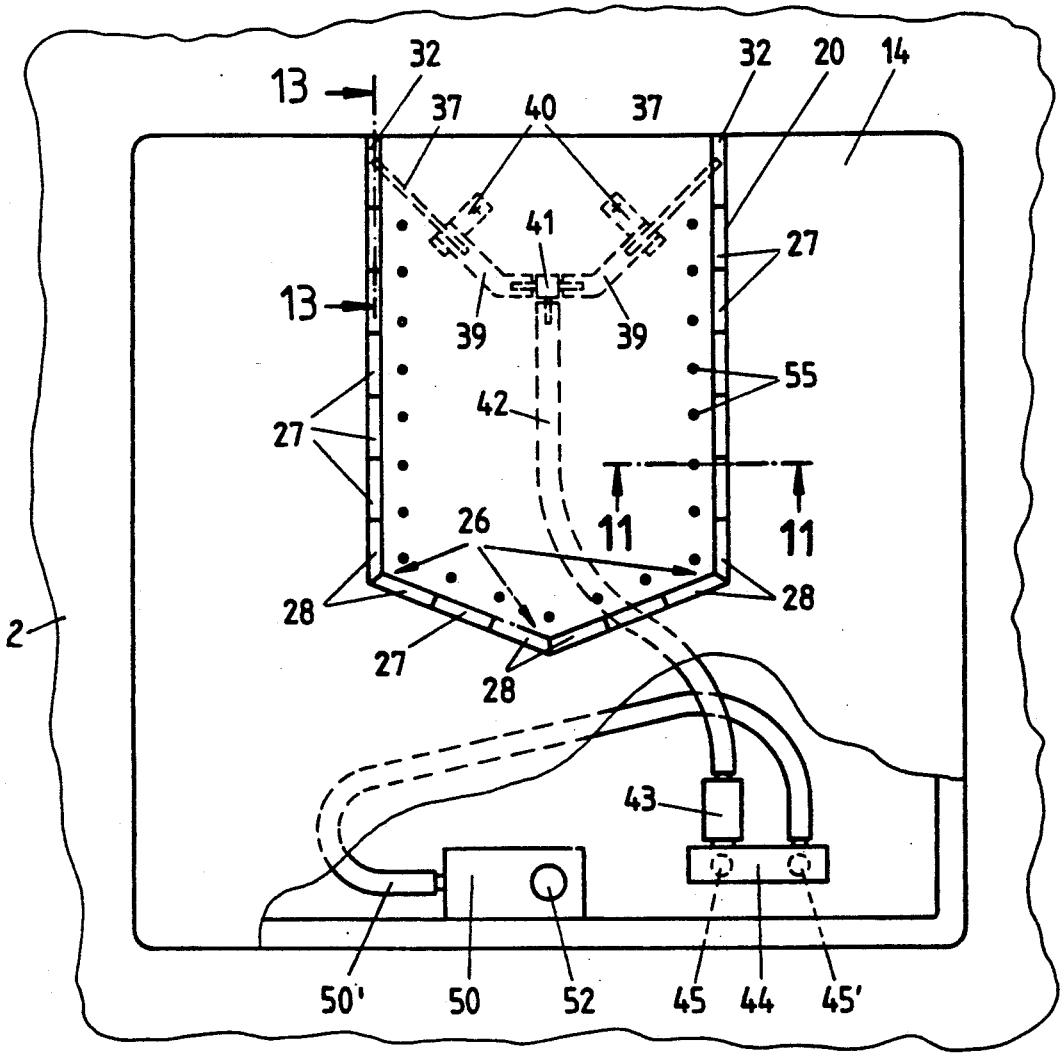
FIG. 10 is a top view of the insert plate.
Figure 13:
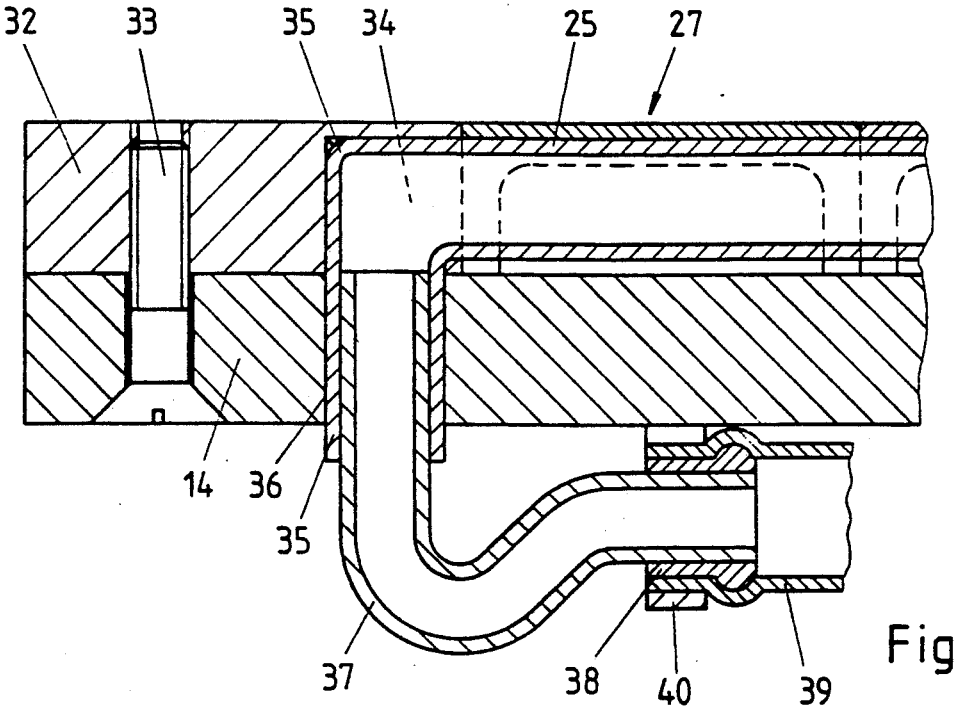
FIG. 13 is an enlarged sectional view taken along section line 13—13 in FIG. 10, showing the end region of the pressure hose.

At each end of the groove 20, as shown in FIGS. 10 and 13, is an end-piece 32 which is firmly attached by a screw 33 to the insert plate 14, the top of the end piece 32 terminating flush with the top 31 of the insert plate 14. As shown in FIG. 13, an angular hole 34 is provided in the end-piece 32 in order to receive a hose end 35. The bent part of the hose end 35 is received by another hole 36 which is aligned with the hole 34 in the insert plate 14. As shown in FIG. 13, the hose end 35 passes through the hole 36 and extends beyond the bottom of the insert plate 14. A length of pipe 37 is securely forced into each hose end 35. At the free end of each length of pipe 37 there is fastened a hose nozzle 38 over which a hose 39 is pushed (see FIG. 13). A cable clamp 40 secured at the bottom of the insert plate 14 secures the connection of the length of pipe 37 to the hose 39.

The other end of each hose 39 is secured to a corresponding connection socket of a tee 41 (FIG. 10), which is an ordinary commercial pneumatic part. Secured to the third connecting socket of the tee 41 is a further hose 42, the free end of which receives the plug part of a quick-detachment pneumatic plug coupling 43. The latter is functionally connected with a distributor block 44 which, as shown in FIG. 5, is fastened on the cover plate 18. A connecting nipple 45 extends outward from the distributor block 44. Over the nipple 45 there is placed another hose 46 which leads to an ordinary 3/2-way solenoid valve 47. The valve 47 is connected to an ordinary pressure reducer 48 which is functionally connected to an external source of compressed air 49.

As shown in FIG. 5, a single-acting compressed air cylinder 50 is fastened to the cover plate 18. From the latter a length of hose 50' extends to the distributor block 44 (see FIG. 10), from which another connecting nipple 45' extends outward. On the latter there is placed a further hose 45" which leads to a manually actuatable 3/2-way valve 51 which is functionally connected with the external source of compressed air 49. A ram 52 of the compressed-air cylinder 50, when acted on by compressed air, presses against the bottom of the insert plate 14 and facilitates its rapid replacement, in conjunction with the removal of the plug coupling 43 from the distributor block 44.

An outlet connection 53, to which a vacuum line 54 is connected, is firmly attached to the cover plate 18. The vacuum line is connected to a vacuum generator, not shown here.

As shown in FIG. 10, a plurality of suction holes 55 which debouch into the suction chamber 15 are provided in the insert plate 14, close to the groove 20.

Figure 6:
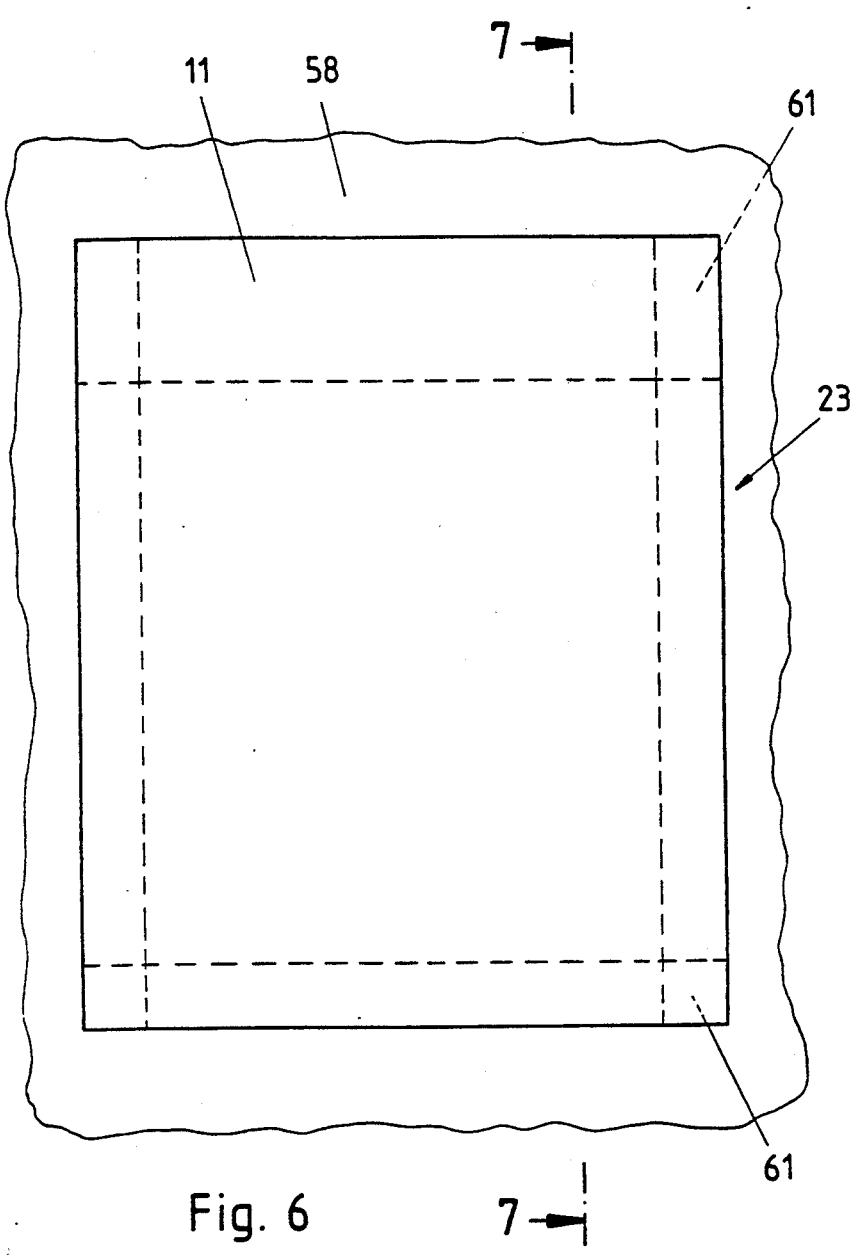
FIG. 6 is a front view of a folded pocket with a rectangular contour.
Figure 7:
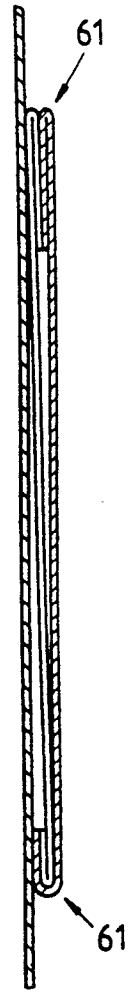
FIG. 7 is a side view of the folded pocket taken along section line 7—7 in FIG. 6.
Figure 8:
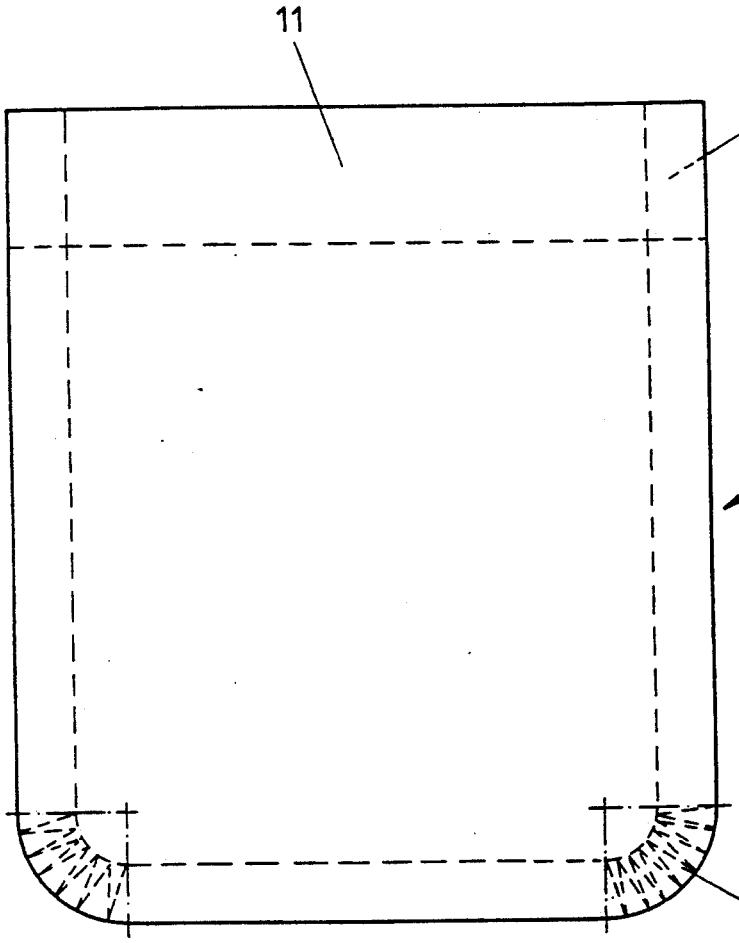
FIG. 8 is a front view of a folded pocket with rounded corners.
Figure 9:
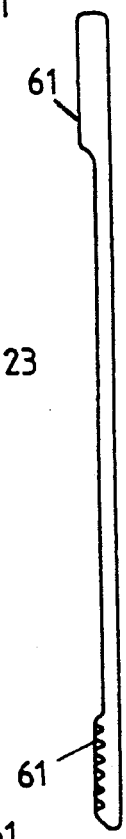
FIG. 9 is a side view of the pocket with rounded corners of FIG. 8.

The automatic sewing machine shown in FIGS. 1 and 2 also has a material holder 56 which can be moved according to X- and Y-coordinates over the support plate 2 under the control of commands which are issued by a control 57. At the receiving station 13, the material holder 56 receives a first piece of material 58, for instance a trouser or shirt blank, which has been placed in the receiving station 13 according to markings, and on which the folded second piece of material 11 has been placed. Thereupon the material holder 56 transports the materials 11, 58 to the sewing head 3. Since the construction and the manner of operation of a background material holder 56 have been described in detail in U.S. Pat. No. 4,793,272, further description can be dispensed with here. In the event of a change in the shape of the second piece of material 11 (see FIGS. 6 and 8), correspondingly shaped structural parts, namely the sword 6, the outer frame 7 and the material holder 56, are attached to the automatic sewing machine.

Figure 16:
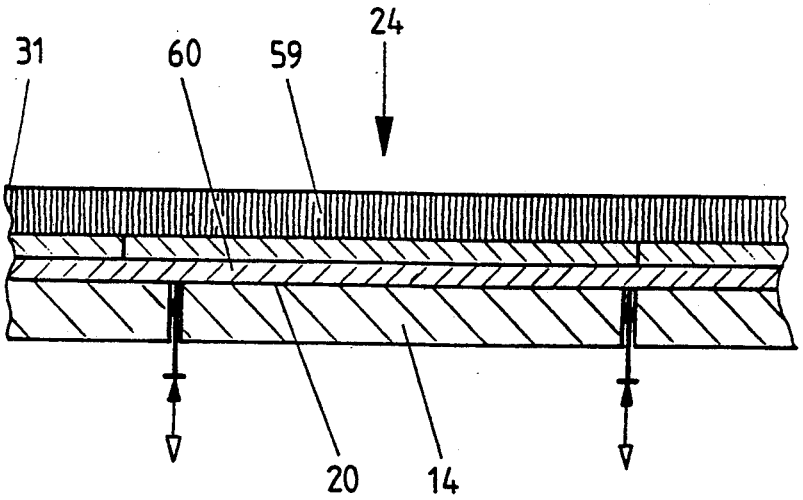
FIG. 16 is an enlarged sectional view taken along section line 13—13 in FIG. 10, wherein narrow brushes are used as a holding element.

In a further embodiment of the invention, shown in FIG. 16, the holding element 24 comprises narrow brushes 59 which are arranged in the groove 20. The tips of the brushes 59 extend temporarily above the topside 31 of the insert plate 14. The brushes 59 are mounted, for instance, on a vertically adjustable carrier 60 which can be raised and lowered within the groove 20 within a given range by conventional means shown schematically in FIG. 16.

Figure 17:
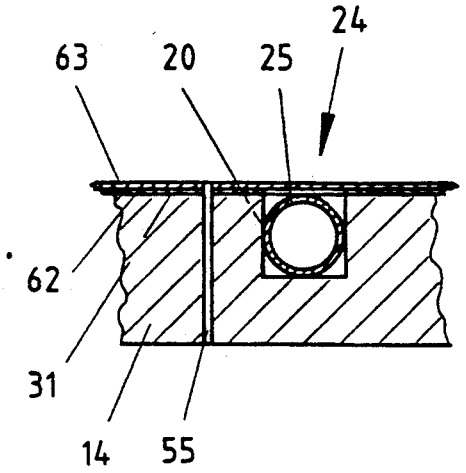
FIG. 17 is an enlarged sectional view taken along section line 11—11 in FIG. 10, wherein the pressure hose is not acted on by compressed air.
Figure 18:
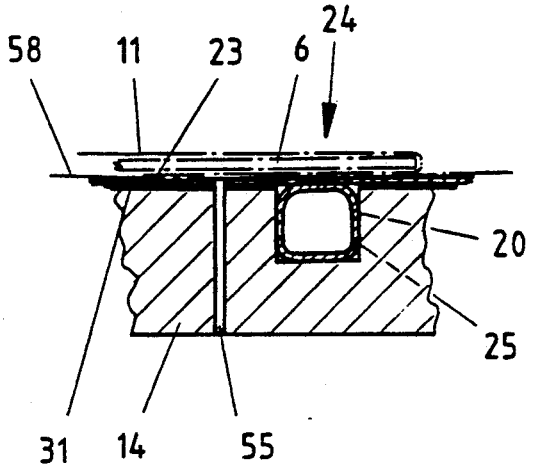
FIG. 18 is an enlarged sectional view taken along section line 11—11 in FIG. 10, wherein the pressure hose is acted on by compressed air.

In another embodiment of the invention, shown in FIGS. 17 and 18, several strips 62 with an adhesive surface on both sides are provided on the topside 31 of the insert plate 14. However, the strips 62 do not cover the groove 20 or the pressure hose 25 present therein. A foil or film 63, which covers the entire surface of the insert plate 14 and the pressure hose 25 embedded therein, is present on the upper adhesive surface of the strips 62.

The manner of operation of the folding device 4 is described below:

The second material 11 is placed on the sword 6 and the protruding edge regions 23 are folded around the sword 6 by the bend-over means 8. Then the sword 6 and the outer frame 7 are swung downward until the bottom of the angle 22 contacts the first material 58 which is on the support plate 2. At this time, the folded edge regions 23 are held between the bottom of the sword 6 and the corresponding arm of each angle 22. Then the pressure hose 25 is pressurized, which causes the bridges 27, 28 to be forced upward out of the groove 20 until the topsides of the bridges 27, 28, in accordance with FIG. 12, are applied against an abutment which is formed by the first material 58 and the second material 11 which is folded around the sword 6. In this way, the folded edge regions 23 of the second material 11 are fixed continuously along the entire length of the folded edges. The bridges 27, 28 fix the edge regions 23 in which there are no thickened portions, just as dependably as those with thickened portions 61 caused by accumulations of layers of material (see FIGS. 6 to 9).

Thereupon the bend-over means 8 are withdrawn into their inactive starting position, shown in FIG. 3. Because the folded edge regions 23 have been fixed as just described, they are prevented from being partly unfolded again by the movement of the bend-over means 8. When the bend-over means 8 have reached their inactive starting position, a vacuum is produced in the suction chamber 15, and the pressure hose 25 is vented via the solenoid valve 47. The vacuum in the suction chamber 15 causes suction to be exerted via the suction holes 55 on the materials 58 and 11, whereby at this time the two materials 58, 11 are fixed to the insert plate 14.

Then, the material clamp 56, which has arrived in the meantime at the removal station 13 (see the dash-dot position of the material clamp 56 in FIG. 2) is lowered onto the materials 11, 58, and the sword 6 is removed from the folded second material 11, and finally the materials 11, 58 are transported to the sewing head 3 by the material clamp 56. These steps are described in detail in U.S. Pat. No. 4,793,272 so that further description can be dispensed with here.

In the second embodiment of the invention, shown in FIG. 16, the holding element 24 comprising brushes 59 arranged end-to-end is shifted upward at the proper time via known setting means (not described here), for instance extendable rams of compressed-air cylinders, or cams. In this connection the tips of the brushes 59 contact the bottom of the first material 58. Due to the resilience of the bristles of the brushes, the brushes 59 also permit continuous fixing of the folded edge regions 23 of the second material 11.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A folding device for an automatic sewing machine for sewing a second material workpiece onto a first material workpiece, the folding device comprising:

a support plate for receiving the first workpiece;

a sword arranged on a sword carrier for receiving the second workpiece;

an outer frame arranged on an outer-frame carrier;

bend-over means on the outer frame for engaging edge portions of said second workpiece and thereby folding said edge portions of the second workpiece around the sword, and for subsequently disengaging from said edge portions;

the sword being movably mounted by its sword-carrier between a lower working position on the support plate, and an upper working position above the support plate, and the outer frame being movably mounted by the outer-frame carrier into a lower working position on the support plate and a position near the upper working position of the sword;

holding means at the support plate for holding the first and second workpieces on the support plate so as to prevent said edge portions from unfolding when said bend-over means disengages from said edge portions; and said holding means being configured and operatively positioned such that force exerted thereby for holding the first and second workpieces on the support plate is concentrated at said edge portions in positions occupied thereby after folding thereof by said bend-over means.

2. A folding device according to claim 1, wherein the holding means comprises a holding element which extends along the folded edges of the second workpiece.

3. A folding device according to claim 2, wherein said holding element extends parallel to a folding edge of said sword, around which the edges of the second workpiece are folded by the bend-over means.

4. A folding device according to claim 2, wherein said holding element projects upward from the support plate and secures the first and second workpieces against the sword.

5. A folding device according to claim 4, wherein a separable insert plate is provided in the support plate and the holding element is embedded in the insert plate.

6. A folding device according to claim 5, wherein the insert plate covers the top of a suction chamber in the support plate.

7. A folding device according to claim 5, wherein the holding element is received in a groove in the insert plate.

8. A folding device according to claim 7, wherein the holding element includes a pressure hose and a plurality of U-shaped bridges which grip around the pressure hose and are arranged movably in the groove above the pressure hose so as to close the groove, substantially flush with a topside of the insert plate, when the pressure hose is unpressurized.

9. A folding device according to claim 8, further comprising a pair of end pieces at respective first and second ends of the groove which are firmly attached to the insert plate, at least one end piece having means for receiving pressure fluid for pressuring said pressure hose.

10. A folding device according to claim 9, wherein in each end piece there is provided a hole which receives a hose end of the pressure hose, in each hose end a length of pipe is inserted securely, and the pressure hose is connected via the length of pipe, a tee, a quick-releasable pneumatic insert coupling, a solenoid valve and a pressure reducer to an external source of compressed air and can thus be alternately acted on by compressed air and vented.

11. A folding device according to claim 7, wherein the holding element includes a plurality of upwardly and downwardly moveable brushes which are arranged in the groove with the tips of the brushes extending above a topside of the insert plate.

12. A folding device according to claim 6, wherein the suction chamber has a recess, the recess receives the insert plate in form-locked manner, and in the region of the recess, a plastic hose is introduced into the support plate, which hose serves as packing and position-securing means between the support plate and the insert plate.

13. A folding device according to claim 6, wherein the bottom of the suction chamber is closed by a cover plate, a compressed air cylinder and a distributor block are provided in the suction chamber, said cylinder and block being fastened to the cover plate, a ram of the compressed air cylinder is capable of pressing temporarily against the bottom of the insert plate for raising the insert plate; and connection nipples on the distributor block and an outlet connection of the suction chamber are fastened to the cover plate and extend outside the suction chamber.

14. A folding device according to claims 7, wherein the holding element includes a pressure hose which is embedded in the groove, adhesive means adhered to the topside of the insert plate, the adhesive means not covering the groove, and film means for covering the entire top surface of the insert plate including the groove.

15. A folding device for an automatic sewing machine for sewing a second material workpiece onto a first material workpiece, the folding device comprising:

support plate means for receiving the first workpiece;

sword means for receiving the second workpiece;

bend-over means for engaging an edge portion of said second workpiece and thereby folding said edge portion of the second workpiece around the sword means, and for subsequently disengaging from said edge portion;

the sword means being movably mounted between a lower working position on the support plate means, and an upper working position above the support plate means;

holding means at the support plate means for holding the first and second workpieces on the support plate means so as to prevent said edge portion from unfolding when said bend-over means disengages from said edge portion; and said holding means being configured and operatively positioned such that force exerted thereby for holding the first and second workpieces on the support plate is concentrated at said edge portions in positions occupied thereby after folding thereof by said bend-over means.

16. A folding device for an automatic sewing machine for sewing a second material workpiece onto a first material workpiece, the folding device comprising:

a support plate for receiving the first workpiece;

a sword arranged on a sword carrier for receiving the second workpiece;

an outer frame arranged on an outer-frame carrier;

bend-over means on the outer frame for engaging edge portions of said second workpiece and thereby folding said edge portions of the second workpiece around the sword, and for subsequently disengaging from said edge portions;

the sword being movably mounted by its sword-carrier between a lower working position on the support plate, and an upper working position above the support plate, and the outer frame being movably mounted by the outer-frame carrier into a lower working position on the support plate and a position near the upper working position of the sword;

holding means at the support plate for holding the first and second workpieces on the support plate so as to prevent said edge portions from unfolding when said bend-over means disengages from said edge portions;

said holding means comprising a holding element which extends along the folded edges of the second workpieces; and said holding element projecting upward from the support plate and securing the first and second workpieces against the sword.

17. A folding device according to claim 2 wherein the holding element is operatively constructed to self align with tow different fabric thicknesses that may be encountered by the holding element at different locations along the folded edges of the second workpiece.

* * * * *